US007968184B2

(12) United States Patent
Humphreys et al.

(10) Patent No.: US 7,968,184 B2
(45) Date of Patent: Jun. 28, 2011

(54) EROSION RESISTANT SURFACE AND METHOD OF MAKING EROSION RESISTANT SURFACES

(75) Inventors: Alan Humphreys, Somerville, MA (US); Geoff Downton, Sugarland, TX (US)

(73) Assignee: Schlumberger Technology Corporation, Cambridge, MA (US)

( * ) Notice: Subject to any disclaimer, the term of this patent is extended or adjusted under 35 U.S.C. 154(b) by 707 days.

(21) Appl. No.: 11/949,386

(22) Filed: Dec. 3, 2007

(65) Prior Publication Data

US 2009/0142594 A1 Jun. 4, 2009

(51) Int. Cl.
*E21B 7/12* (2006.01)
*E21B 34/04* (2006.01)
*E21B 10/00* (2006.01)

(52) U.S. Cl. ..... 428/332; 166/358; 175/327; 977/742

(58) Field of Classification Search ..... 166/358; 175/327–435; 977/778, 742; 428/332
See application file for complete search history.

(56) References Cited

U.S. PATENT DOCUMENTS

2004/0071870 A1* 4/2004 Knowles et al. ..... 427/200
2008/0179104 A1* 7/2008 Zhang et al. ..... 175/374

OTHER PUBLICATIONS

Bower et al., Plasma-induced alignment of carbon nanotubes, Applied Physics Letters, vol. 77, No. 6, pp. 830-832, Aug. 7, 2000.
Peplow, Nanotube forest does concertina scrunch, BioEd Online, http://www.bioedonline.org/news/news-print.cfm?art=2176, MacMillan Publishers Ltd., Nov. 24, 2005.

* cited by examiner

*Primary Examiner* — D. Lawrence Tarazano
*Assistant Examiner* — Matthew D Matzek
(74) *Attorney, Agent, or Firm* — Brigid Laffey; Helene Raybaud

(57) ABSTRACT

An erosion resistant surface using a dense array of elastic whiskers to slow the velocity of erosive particles before impacting with the surface. A carbon nanotube forest is grown on the surface to provide the erosion resistance. In the alternative, a carbon nanotube forest is grown on a flexible substrate that is bonded to the surface.

20 Claims, 4 Drawing Sheets

MICROGRAPH OF CNT FOREST

EROSION RESISTANT SURFACE AND METHOD OF MAKING EROSION RESISTANT SURFACES

TECHNICAL FIELD

The present invention relates to controlling erosion on apparatuses exposed to highly erosive environments. More particularly, the present invention relates to application of a dense network of elastic fibers to wellbore tools and equipment.

BACKGROUND OF THE INVENTION

Erosive wear occurs when a surface is exposed to a flow of material in a fluid. Particles within the fluid impact on the exposed surface and impart some of their kinetic energy into the exposed surface. If sufficiently high, the kinetic energy of the impacting particles creates significant tensile residual stress in the exposed surface, below the area of impact. Repeated impacts cause the accumulation of tensile stress in the bulk material that can leave the exposed surface brittle and lead to cracking, crack linkage and gross material loss.

Erosive wear is a cause for concern in applications as diverse as hydroelectric turbines, jet engine turbine blades, aircraft surfaces and wellbore drilling and stimulation environments. Each situation has its own particular challenges in mitigating erosive wear. Hydroelectric turbines are subject to high velocity flows of water mixed with various amounts of silt and sand. Jet engine turbine blades are subject to flows of superheated, high velocity gases. Aircraft surfaces must withstand high speed movement through air particulates such as rain, ice, dirt, and acidic pollution. Tools and equipment for wellbore exploration, including drilling and formation stimulation, are subject to a constant flow of mud and sand.

Typically, components that are exposed to erosive flow are subject to various hardfacing treatments to improve erosion resistance. Such treatments often include either surface preparations that harden and smooth the base material itself or bonding erosion resistant materials to the surface of the base material. Surface preparations can often make the base material more resistant to impact from particles with low kinetic energy, but these same preparations can leave the base material more brittle and thus susceptible to cracking as a result of impacts from high kinetic energy particles. Also, such surface preparations are usually applied using high-temperature processes, thus limiting their applicability only to high-temperature resistant materials such as metals and ceramics. Bonding of erosion resistant materials is typically performed using thermal spray techniques such as High Velocity Oxy-Fuel (HVOF) or Air Plasma Spray (APS). These techniques use a fuel/oxygen mixture or a DC arc to melt a metal powder and spray it onto the surface to be coated. As such, high-heat bonding techniques are amenable only for use on high-temperature resistant materials. Further, in highly erosive environments, the residual tensile stress that results from multiple impacts can accumulate at the junction of a base material and its bonded coating, leading to delamination of the coating material.

An addition issue arises when components of a device are difficult to access once put in place. For example, many devices are manufactured to be replaceable (e.g., the device may be welded, snapped or riveted together) rather than serviceable. In other instances, a device may be permanently placed in an inaccessible location, being intended to serve reliably for the lifetime of the structure (e.g., devices cemented into structure walls). In such cases, it is common to "over-design" the component such that it can reliably perform its function for the life of the device, even if the component is badly eroded. As a result, the cost of design and manufacture of such components may be significantly increased, along with their size and strength.

Erosion control is of particular concern in wellbore operations. During wellbore drilling, a drilling mud, usually consisting of significant amounts of solids such as sand, chert or other rock suspended in water, is constantly pumped into the wellbore at velocities that can exceed 50 meters per second. The drilling mud provides cooling to bottomhole assemblies, hydraulic horsepower to mud motors that rotate the drill bit, and a medium for removing the cuttings. In this environment, the mud motor rotor and stator are subject to significant erosive forces, as are the drill bit and particularly the shirttails (the exposed outer face of the roller cone-bearing journal).

Likewise, in wellbore completions, such as gravel packing or fracturing operations, a slurry of particles suspended in a liquid are pumped under high pressure into the wellbore. In gravel packing, gravel of various sizes is pumped into an angular flow diverter to pack the annulus between the wellbore and the casing with gravel, to prevent the production of formation sand. In fracturing, the slurry includes a propant, typically sand, that is pumped into the formation to stimulate low-permeability reservoirs. Here, the angular flow diverters are subject to erosive wear.

Because of the harshly erosive environment of wellbore operations, significant effort and expense is expended to mitigate erosive loss and improve wellbore tool and equipment life. Hardfacing treatments, as described above, are used extensively to protect a wide array of wellbore tools. Also, wellbore tools and equipment are often over-designed to provide adequate service life. Additional steps are often taken to treat the fluids to make them less erosive. However, all of these steps routinely prove inadequate to provide sufficient protection from erosion, and wellbore operations are often interrupted to replace broken tools that were unable to withstand the prolonged stress.

From the foregoing it will be apparent that there is a need for an improved method of providing erosion resistance to components exposed to a flow of erosive material.

DETAILED DESCRIPTION OF THE INVENTION

Figure 1:
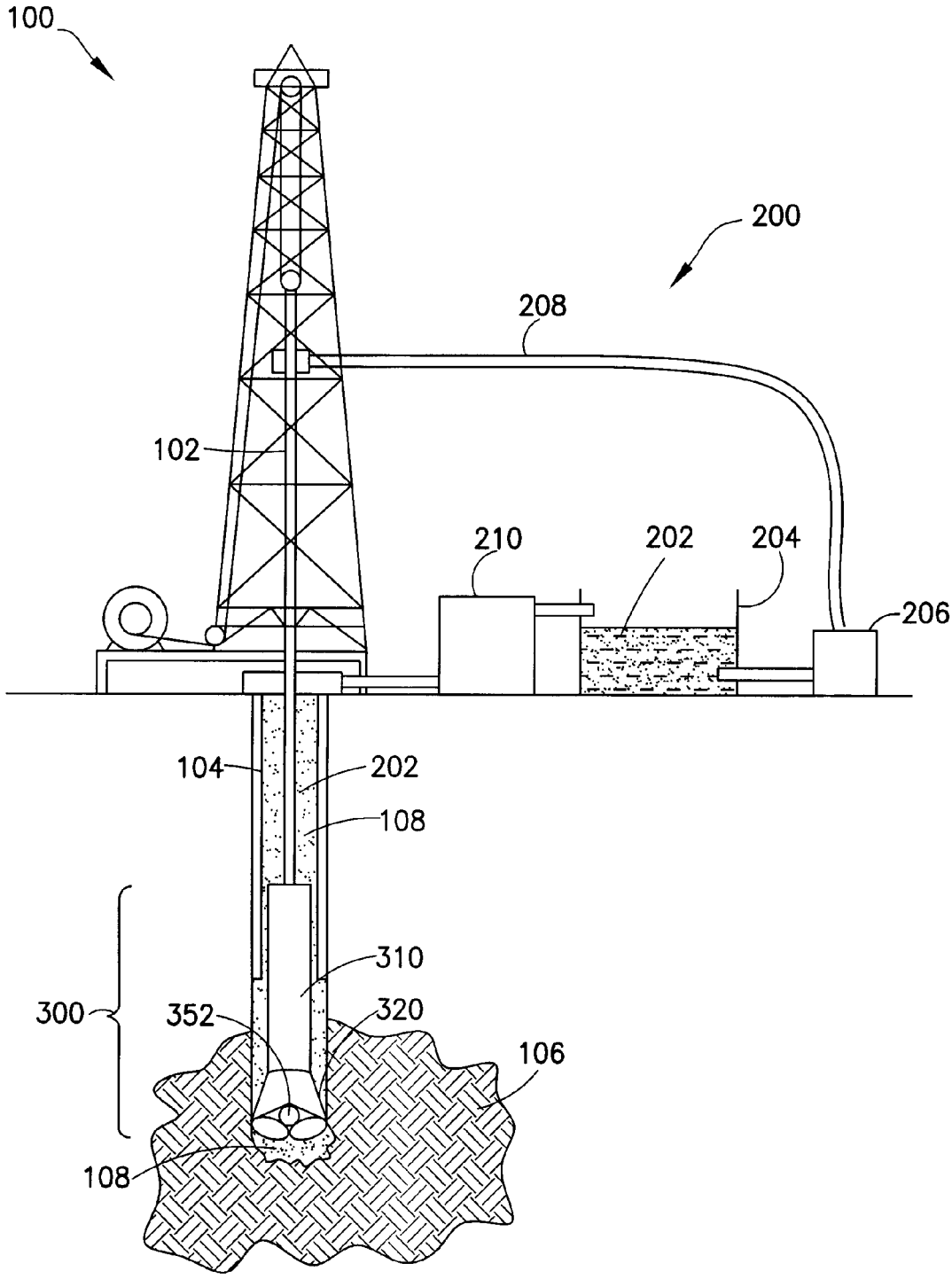
FIG. 1 illustrates a drilling rig with its associated mud circulation systems, surface downhole assembly and subsurface downhole assembly.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

The description and examples are presented solely for the purpose of illustrating the preferred embodiments of the invention and should not be construed as a limitation to the scope and applicability of the invention. While the compositions of the present invention are described herein as comprising certain materials, it should be understood that the composition could optionally comprise two or more chemically different materials. In addition, the composition can also comprise some components other than the ones already cited. In the summary of the invention and this detailed description, each numerical value should be read once as modified by the term "about" (unless already expressly so modified), and then read again as not so modified unless otherwise indicated in context. Also, in this detailed description, it should be understood that any cited numerical range listed or described as being useful, suitable, or the like, should be considered to include any and every point within the range, including the end points. For example, "a range of from 1 to 10" is to be read as indicating each and every possible number along the continuum between about 1 and about 10. Thus, if any or all specific data points within the range, or conversely no data points within the range, are explicitly identified or referred to, it is to be understood that inventors appreciate and understand that any and all data points within the range are to be considered to have been specified, and that inventors convey possession of the entire range and all points within the range.

The disclosure shows an improved erosion resistant surface, and methods of applying the same. By applying a dense network of elastic fibers, also known as elastic whiskers, to a surface, the force of particles impacting with the surface is reduced, and so resistance to erosion is improved. A carbon nanotube forest is one example of a dense network of elastic whiskers. Tools and equipment that utilize this improved erosion resistant surface can withstand higher flow rates without experiencing increased amounts of erosion. Also, tools and equipment which are currently designed with thicker, heavier, less erosion-resistant surfaces can be redesigned to be more compact and lighter using this improved surface. Further, the low-temperature methods of surface application described herein will allow new materials to be considered for use in highly erosive environments.

INTRODUCTION

Disclosed herein are erosion resistant surfaces and methods of manufacturing them. While the disclosure is described in relation to well-drilling methods and apparatus, it must be recognized that this particular application of the disclosure is not the only possible application, and that the erosion resistant surfaces and methods described herein provide great benefit to other applications where erosion is a concern.

FIG. 1 illustrates a drilling rig 100 with its associated mud circulation systems 200 and subsurface downhole assembly 300. In drilling a well, drilling mud 202 is pumped from a surface reservoir 204 by the mud pump 206 through a hose 208 into a string of standpipes 102 into the wellbore 104. At the bottom of the wellbore 104 the standpipes 102 are attached to the bottom hole assembly 300 that typically includes a mud motor 310 and a drill bit 320. At the bottom hole assembly 300, the drilling mud 202 drives the mud motor 310 to rotate the drill bit 350. The drilling mud 202 then flows through and cools the drill bit 350 and is ejected from the drill bit 350 through nozzles 352, to lubricate the drill bit 350 at the face of the formation 106, and to carry the cuttings 108 from the formation 106. The drilling mud 202 mixed with cuttings 108 flows back up the wellbore 104 to the surface mud system 210 where the cuttings 108 are removed from the drilling mud 202. The surface mud system 210 typically includes a series of shale shakers, degassers, desanders and mud cleaners (all not shown) that remove the majority of the cuttings 108 from the drilling mud 202. The clean drilling mud 202 is then discharged into the surface reservoir 204, where it is recycled as the process begins again.

The drilling mud 202 can be water-based, oil-based or synthetic-based. While the surface mud system 210 is effective in removing most of the cuttings 108 from the drilling mud 202, there is typically some residual amount of fine particulate matter, composed of sand, chert or other rock, that remains suspended in the drilling mud 202. Therefore, no matter how clean the drilling mud 202 is at the beginning of drilling operations, it quickly becomes a gritty fluid that, when pumped at high velocity and high pressure, is highly erosive to the components in the mud pump 206 and in the bottom hole assembly 300.

Figure 2A:
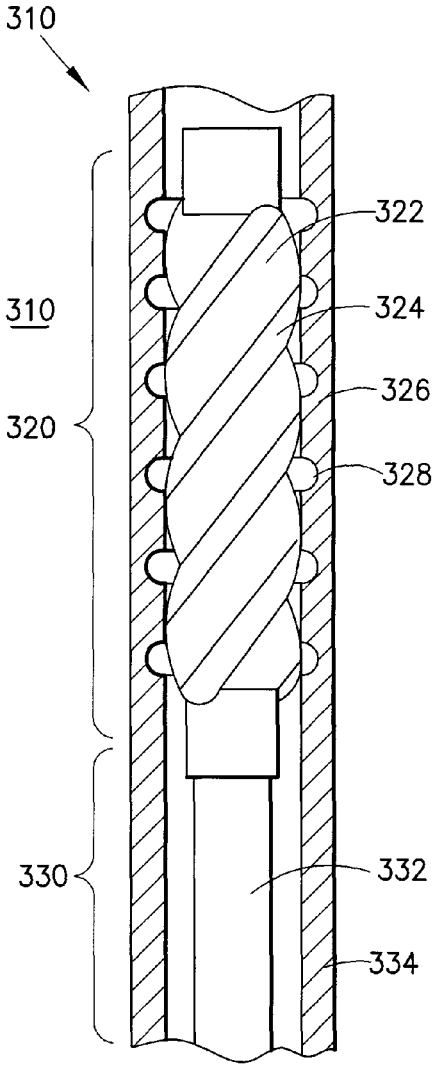
FIG. 2 is a cross-section of a downhole assembly that includes a mud motor and a drill bit.
Figure 2B:
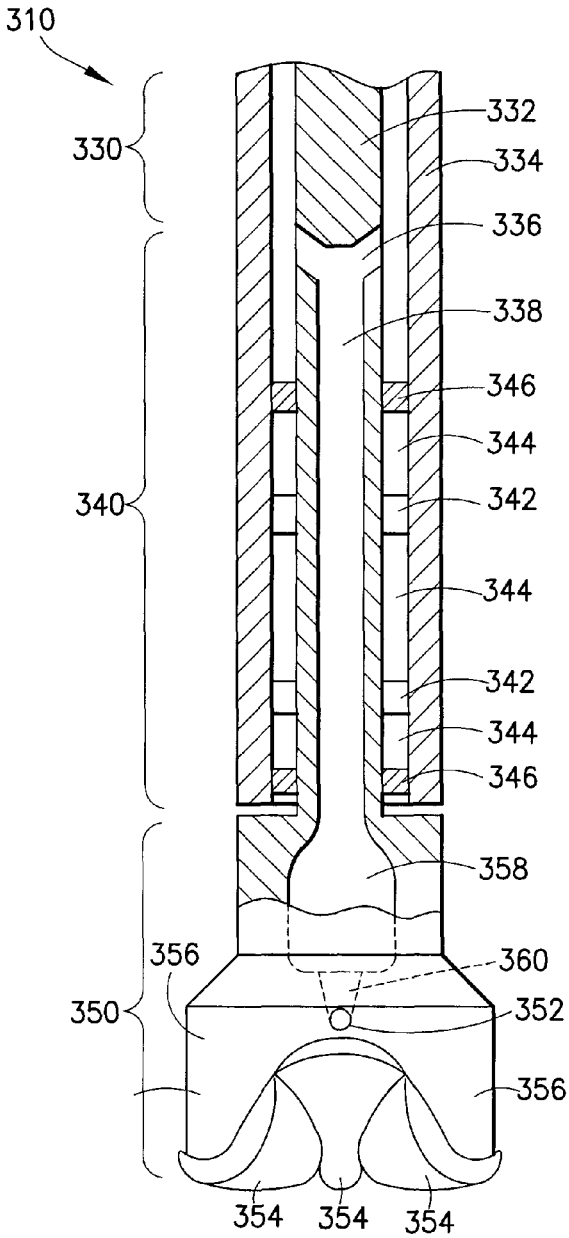

In particular, FIG. 2 (which is presented as partial views illustrated in FIGS. 2A and 2B, respectively) shows the bottom hole assembly 300 that consists of a mud motor 310 and a drill bit 350. The mud motor 310 is a kind of cavity pump that translates the linear flow of drilling mud 202 into a shaft rotation that twists the drill bit 350. The mud motor 310 includes a power section 320, in FIG. 2A, a transmission section 330, FIGS. 2A and 2B, and a bearing section 340, FIG. 2B. The power section 320 includes a rotor 322 with a number of vanes 324 spiraling along the length of the rotor 322. The power section 320 also includes a fixed stator 326 with a number of lobes 328. The rotor 322 diameter is such that the outer edges of the vanes 324 fit within the inner diameter of the lobes 328 on the stator 326. In this way, the rotor 322 is free to rotate, but the fact that the vanes 324 and the lobes 328 remain in contact forms a seal around which the drilling mud 202 cannot pass.

The flow of drilling mud 202 under high pressure, flowing between the rotor 322 and the stator 326, thus causes the rotor 322 to turn a flexible transmission shaft 332 in the transmission section 330. The transmission section 330 may include a bend of from 0 to 4 degrees, to change the direction of the wellbore, as is well known in the art. The drilling mud 202, after exiting the power section 320, flows between the transmission shaft 332 and the transmission section wall 334.

The bearing section 340 includes several thrust bearings 342 that permit free rotation of the transmission shaft 332 and bear the load of the drilling operations. The bearings are surrounded by lubricant 344 and enclosed by upper and lower seals 346. At the transition between the transmission section 330 and the bearing section 340, the transmission shaft 332 is fashioned as a hollow tube with an inner channel 338. Several passages 336 link the annulus between the transmission shaft 332 and the transmission section wall 334 with the inner chamber 338, permitting the drilling mud 202 to flow to the drill bit 350.

The drill bit 350 shown is a rotary cone-type drill bit that has three wheels 354 attached to the shirttails 356 that form the outer diameter of the drill bit 350. The drilling mud 202 flows into a chamber 358 with channels 360 to the nozzles 352. The flow of drilling mud 202 provides cooling for the drill bit 350, lubrication for the wheels 354 against the face of the formation 106 and a medium for carrying the cuttings 108 away from the formation.

In this context, the drilling mud 202 is highly erosive because it retains particles from the cuttings 108 that the surface mud system 210 was unable to remove and because it is flowing at velocities in excess of 50 meters per second. In the power section 320, the contact point between the vanes 324 and inner surface of the stator 324 is particularly susceptible to erosive wear; material loss at this juncture can permit drilling mud 202 to flow between the rotor and the stator, resulting in less efficient operation of the mud motor 310. The seals 346 in the bearing section 340 are also susceptible to erosive wear. Failure of the seals 346 would permit the bearings 342 to become exposed to the gritty drilling mud 202, resulting in a seized bearing 342. At the drill bit 350, the seals for the wheel 354 bearings (both not shown) are exposed to erosive wear and are likewise susceptible to seizing. Also, the shirttails 356, forming the narrowest constriction between the drill bit 350 and the wellbore 104 experience the erosive force of not just the drilling mud 202, but also of the cuttings 108. Erosive wear of the shirttails 356 can result in a broken drill bit 350. All of these problems include the additional cost of pulling the entire drill string from the well to replace or repair the failing component.

Erosion Resistance

Figure 3:
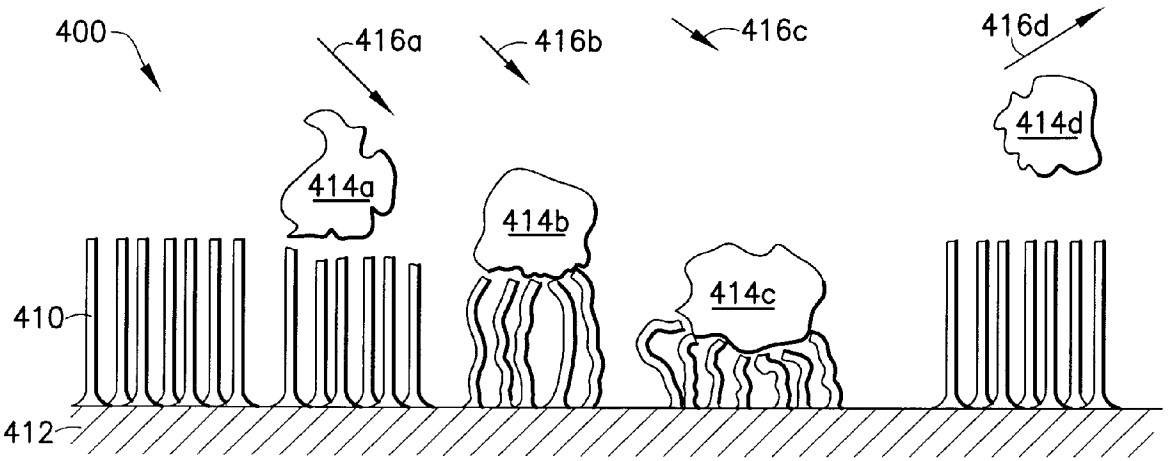
FIG. 3 is a cross-section illustrating the surface of a drilling tool with improved erosion control provided by a dense network of fibers attached to the surface, according to one embodiment of the present disclosure.

FIG. 3 is a cross-section illustrating the surface of a drilling tool with improved erosion control provided by a dense network of fibers attached to the surface. In the embodiment shown, an erosion resistant surface 400 is made up of a dense network of fibers 410 attached to the surface 412 that requires erosion resistance.

In FIG. 3, erosive particles 414 are shown in various stages of impact with the surface 412. The velocity of each particle is shown by an associated vector 416 whose direction corresponds to the direction of travel of the particle 414, and whose length corresponds to the speed of the particle 414. Particle 414*a* is shown just before impact with the surface 412 and is traveling at a high velocity as depicted by vector 416*a*. Particle 414*b* is about to impact with the surface 412, but is first impacting with the fibers 410 attached to the surface 412. Because of the elastic properties of the fibers 410, the fibers 410 deform without breaking, absorbing the kinetic energy of particle 414*b*, and thus reducing the speed of particle 414*b*, as depicted by vector 416*b*. Particle 414*c* has impacted with the surface 412, but the further deformation of the fibers 410 has further reduced the kinetic energy and velocity of particle 414*c*, as depicted by vector 416*c*. Particle 414*d* has bounced off of the surface 412 and, the fibers 410 having imparted the stored spring energy back to the particle 414*d*, is traveling at a high velocity away from the surface 412 as depicted by vector 416*d*.

The effectiveness of the above-described erosion control mechanism may be understood by considering the factors that affect erosion rate. A general equation for the material removal rate of a brittle coating by erosive damage is given by the following equation:

$$Q\Omega t = C\frac{Mv^n H^m}{K_{IC}} \text{ (in mm}^3\text{/hr)}$$

Where Q is the volume of material removed per particle impact, Ω is the particle flux, t is time, M and ν are respectively the mass and velocity of the particle, H and $K_{IC}$ are respectively the hardness and the fracture toughness of the surface, and C is a geometrical scaling factor. The velocity exponent, n, is typically 2.4 to 3.2, and the hardness exponent, m, is typically −0.5 to 0.1. Because the material removal rate varies with particle velocity to an exponent of 2.4 to 3.2, even small reductions in the velocity of the particle 414 before impacting with the surface 412 will lead to significantly reduced erosion rates. For example, assume the erosion rate is proportional to the particle's 414 speed to an exponent of 3.0, and the network of fibers are capable of reducing the speed of the particle 414 from 10 meters per second to 7.5 meters per second before the particle 414 impacts with the surface 412. Before impact, the particle 414 would cause erosion proportional to 1000 meters$^3$/second$^3$ ($1000=10^3$). With the reduced velocity, the particle 414 will cause erosion proportional to 422 meters$^3$/second$^3$ ($422=7.5^3$). Therefore, in this example, the effect of the erosion resistant surface 400 is to reduce the erosion rate experienced by the surface 412 by 58%. Thus, because of the exponential relationship between speed and erosive force, even modest reductions in speed can result in a significantly lower erosion rate. With all impacting particles considered cumulatively, the reduced speed at impact produces dramatic improvements in erosion resistance.

If the erosive particles 414 exist in a flowing fluid (not shown), then, in addition to the elastic properties of the fibers 410, the surface 412 is further protected by the effect of the impacting particle 414 extruding the fluid from between the fibers 410. Here, the fluid is free to flow between the fibers 410. In this case, the fluid between the fibers 410 has a higher viscosity than the fluid outside of the fibers 410, because of the restriction to free flow created by the network of fibers 410. Therefore, when a particle 414 impacts the fibers 410, the particle 414 not only deflects the fibers 410, but also displaces the higher viscosity fluid from between the fibers 410. This added resistance improves the ability of the erosion resistant surface 400 to reduce the speed of incoming particles 414, and provides further improvement in erosion resistance.

Carbon Nanotubes

Figure 4:
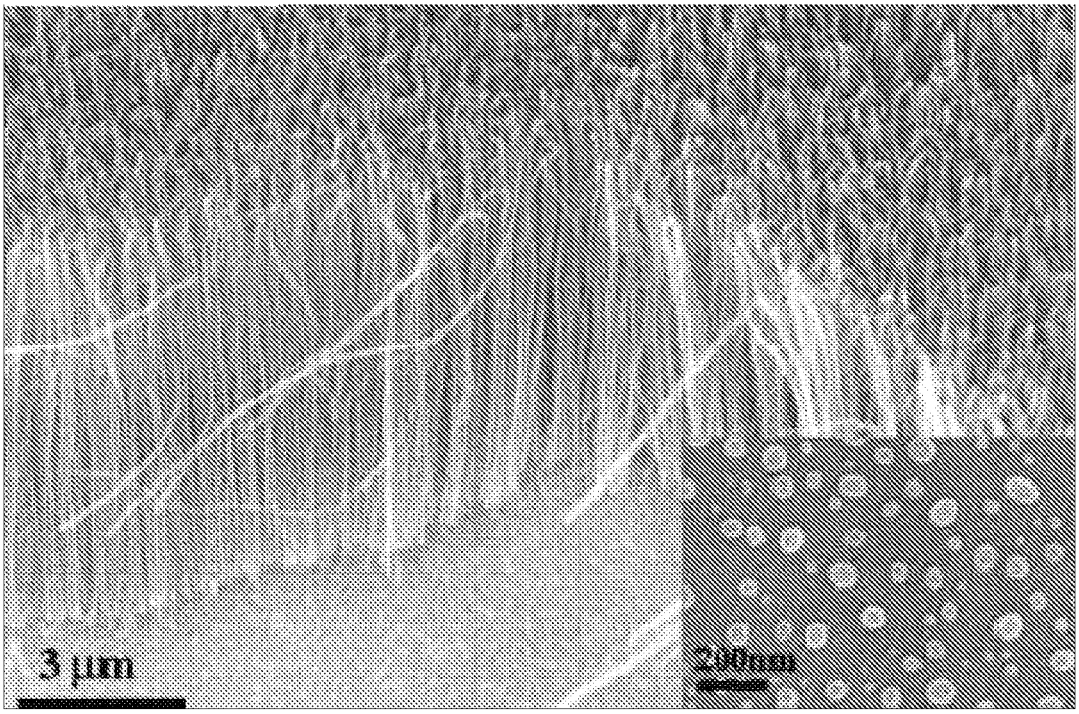
FIG. 4 shows a forest of carbon nanotubes, according to one embodiment of the present disclosure.

In order to confer sufficient erosion resistance, the network of fibers 410 should be densely packed and strongly bonded to the surface 412. In addition the fibers 410 should have a high elastic modulus and be hard enough to resist the cutting action of the faceted edge of typically erosive particles 414, such as sand. In one embodiment of the present invention, the network of fibers 410 consists of a forest of carbon nanotubes, as shown in FIG. 4. Carbon nanotubes are different allotropes of carbon that consist of either a single one-atom thick sheet of graphite rolled into a seamless cylinder (single-walled nanotubes [SWNTs]) or multiple sheets of graphite rolled into a tube (multi-walled nanotubes [MWNTs]).

Several methods are available for synthesis of multi-walled nanotubes that make these very attractive for surface treatments. One such method is Chemical Vapor Deposition (CVD), where the surface of the article to be treated is seeded with catalyst particles, and is exposed at high temperature to a carbon-containing gas such as acetylene or ethylene, thus growing the multi-walled nanotubes on the catalyst particles. The diameter, surface density and structure of the multi-walled nanotubes is related to the size and surface density of the catalyst particles. Catalysts commonly include nickel, cobalt or iron. Carbon nanotube forests can be grown with lengths in excess of 2.5 millimeter, and with distances between nanotube of between 0.2 micron ($0.2\times10^{-6}$ meter) to 2 microns ($2.0\times10^{-6}$ meter) or more. Other methods of forming multi-walled nanotubes are available; including arc-discharge or laser ablation, and other methods may be developed in the future. Therefore, the method of carbon nanotube synthesis used, and the length and surface density of the nanotubes are not intended to form a limitation on the scope of the present invention.

Figure 5:
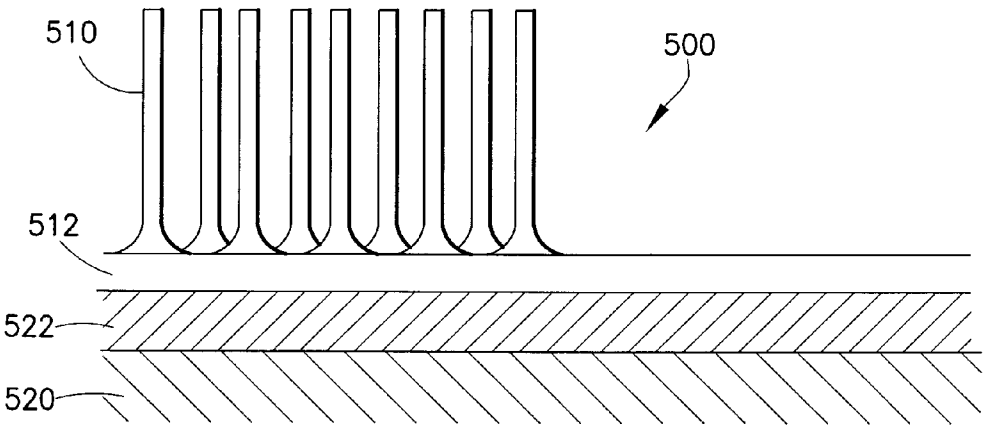
FIG. 5 shows a flexible carbon nanotube forest attached to a surface requiring erosion resistance through an appropriate bonding material.

In another embodiment, shown in FIG. 5, a flexible carbon nanotube forest 500 is attached to the surface requiring erosion resistance 520 through an appropriate bonding material 522. In that embodiment, the flexible carbon nanotube forest 500 is fashioned by synthesizing multi-walled nanotubes 510 on a flexible substrate 512. The bonding material 522 is chosen to best fasten the flexible substrate 512 to the surface 520, such as an epoxy, and may be used in combination with other processing steps to pre-condition either the flexible substrate 512 or the surface 520 to better adhere to the bonding material 522.

Example

Assume that an incoming erosive particle buckles a carbon nanotube in a perfectly elastic manner. The buckling stress for a cylinder F, is:

$$f = \frac{\pi^2 EI}{4L^2}$$

where E is the elastic modulus of the carbon nanotube, L is the length and I is the moment of inertia. A carbon nanotube is a hollow cylinder so I is given as:

$$I = \frac{\pi(r_2^4 - r_1^4)}{4}$$

where $r_1$ is the inner radius and $r_2$ is the outer radius. Assume that the force prior to buckling is negligible and that the post-buckling force is constant. If a carbon nanotube is deflected to half its height by an impacting particle, then the energy absorbed by the nanotube, W, will be:

$$W = \frac{\pi^3 E(r_2^4 - r_1^4)}{32L}$$

Assume that the individual carbon nanotubes within the forest are arranged in a square matrix on the substrate and separated by a distance of $2r_2$. Further, assume that a cubic sand particle, with length d on each edge, and density ρ, is traveling with velocity v, and impacts normal to the surface. Then the number of carbon nanotubes that will absorb the energy of impact, N, is given as:

$$N = \frac{d^2}{16r_2^2}$$

Therefore, the total energy absorbed by the collision, $W_T$, will be:

$$W_T = \frac{\pi^3 Ed^2(r_2^4 - r_1^4)}{512Lr_2^2}$$

The kinetic energy of the particle, J, will be:

$$J = \frac{\rho d^3 v^2}{2}$$

Therefore, the maximum velocity of the particle that can be completely stopped, $v_{max}$, is:

$$v_{max} = \sqrt{\frac{2W_T}{\rho d^3}} = \sqrt{\frac{\pi^3 E(r_2^4 - r_1^4)}{256L\rho d r_2^2}}$$

For a typical carbon nanotube forest, the length of the nanotubes, L, is about 1 μ-meter ($=1\times10^{-6}$ meter), the outer diameter, $r_2$, is 100 n-meter ($=100\times10^{-9}$ meter), the inner diameter $r_1$, is 50 n-meter ($=50\times10^{-9}$ meter) and the elastic modulus, E, is 1 T-Pascal ($=1\times10^{12}$ Pascal). Further, assume a cubic sand particle of length, d, on each edge of 1 millimeter, and a density, ρ, of 3 grams per cubic centimeter. From the calculations above, the maximum particle velocity, $v_{max}$, that can be completely cushioned is ~20 meters per second. Or, viewed another way, if the surface is exposed to a maximum particle velocity of 50 meters per second, but the erosion resistant surface of the present invention can reduce the particle velocity to 30 meters per second, then the erosive wear, being a function of velocity to the third power (as discussed above), is reduced by 78%.

The improvements in erosion resistance achieved using the herein-described technologies permit new and various approaches to the design of components that must withstand highly erosive environments. For example, applying a carbon nanotube forest to existing designs enables those designs to withstand higher flow rates without sacrificing service life. Furthermore, devices employing carbon nanotube forests as described herein may be designed with less concern for erosive wear, thus allowing for lighter and smaller design. Also, particularly when using the flexible carbon nanotube forest 500, erosion resistance formerly available only to high-temperature materials is now readily applicable to a wide range of low-temperature materials, because many bonding processes, and in particular, epoxy processes, are low temperature processes.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about A to about B," or, equivalently, "from approximately A to B," or, equivalently, "from approximately A-B") disclosed herein is to be understood as referring to the power set (the set of all subsets) of the respective range of values. Accordingly, the protection sought herein is as set forth in the claims below.

We claim:

1. A method of using an erosion resistant device for use in a subterranean environment comprising:

using said erosion resistant device which comprises an erosion resistant surface having an array of elastic whiskers attached to the erosion resistant surface and wherein the array of elastic whiskers reduces a speed of a particle impacting the erosion resistant surface thus reducing an erosion rate of the erosion resistant surface.

2. The erosion resistant device of claim 1 wherein said elastic whiskers being of a material with an elastic modulus of between 250 giga-pascals and 1 tera-pascal.

3. The erosion resistant device of claim 1 wherein the array of elastic whiskers comprises a forest of vertically-aligned carbon nanotubes.

4. The erosion resistant device of claim 3 wherein the vertically-aligned carbon nanotubes comprise carbon nanotubes of between 0.5 micrometers (0.5×10E-6 meter) and 50 micrometers (50×10E-6 meter) in length.

5. The erosion resistant device of claim 4 wherein the vertically-aligned carbon nanotubes comprise carbon nanotubes of between 1 micrometers (1×10E-6 meter) and 30 micrometers (30×10E-6 meter) in length.

6. The erosion resistant device of claim 3 wherein the vertically-aligned carbon nanotubes comprise carbon nanotubes of between 1 nanometers (1×10E-9 meter) and 100 nanometers (100×10E-9 meter) in diameter.

7. The method of using the erosion resistant device of claim 1 wherein the erosion resistant surface is a surface of a drilling tool.

8. The method of using the erosion resistant surface of claim 2 wherein the carbon nanotubes are densely packed and strongly bonded to the surface.

9. The method of using the erosion resistant surface of claim 1 wherein the particle is an erosive particle.

10. The method of using the erosion resistant surface of claim 9 wherein the erosive particle is sand.

11. The method of using the erosion resistant surface of claim 9 wherein the erosive particle impacting the erosion resistant surface displaces a fluid from between the carbon naonotubes.

12. The method of using the erosion resistant surface of claim 11 wherein the fluid displacement improves erosion resistance.

13. An erosion resistant device for oilfield exploration, drilling, or production comprising:

a component having an erosion resistant surface having an array of elastic whiskers;

wherein the array of elastic whiskers reduces a speed of a particle impacting the erosion resistant surface thus reducing an erosion rate of the erosion resistant surface; wherein the array of elastic whiskers comprises a forest of vertically-aligned carbon nanotubes; and wherein the erosion resistant device is selected from a mud motor rotor, stator, drill bit, and shirttails.

14. The device for oilfield exploration, drilling or production of claim 13 wherein said elastic whiskers are of a material with an elastic modulus of between 250 giga-pascals and 1 tera-pascal.

15. The device for oilfield exploration, drilling or production of claim 13 wherein the forest of vertically-aligned carbon nanotubes is produced by a chemical vapor deposition process.

16. The device for oilfield exploration, drilling or production of claim 13 wherein the forest of vertically-aligned carbon nanotubes is produced by:

growing the carbon nanotube forest on a flexible substrate; and bonding said flexible substrate to the surface.

17. The device for oilfield exploration, drilling or production of claim 13 wherein the component is a mud motor.

18. The device for oilfield exploration, drilling or production of claim 13 wherein the component is a drill bit.

19. A method of producing an erosion resistant surface, comprising:

growing an array of elastic whiskers on a flexible substrate; and bonding said flexible substrate to the erosion resistant surface of the erosion resistant device of claim 13.

20. The method of producing an erosion resistant surface of claim 19 wherein the array of elastic whiskers comprises a forest of vertically-aligned carbon nanotubes.

* * * * *